US006578566B2

(12) United States Patent
Hernandez

(10) Patent No.: US 6,578,566 B2
(45) Date of Patent: Jun. 17, 2003

(54) HIGH EFFICIENCY PAINTBALL MARKER BOLT AND BOLT HEAD

(76) Inventor: Robert Louis Hernandez, 511 Lotz Dr., Yorktown, VA (US) 23692

( * ) Notice: Subject to any disclaimer, the term of this patent is extended or adjusted under 35 U.S.C. 154(b) by 0 days.

(21) Appl. No.: 09/977,977

(22) Filed: Oct. 17, 2001

(65) Prior Publication Data

US 2002/0046748 A1 Apr. 25, 2002

Related U.S. Application Data

(60) Provisional application No. 60/241,802, filed on Oct. 19, 2000.

(51) Int. Cl.[7] ..... F41B 11/00
(52) U.S. Cl. ..... 124/73; 124/55
(58) Field of Search ..... 124/70, 71, 72, 124/73, 74, 75, 76, 77, 55

(56) References Cited

U.S. PATENT DOCUMENTS 4,936,282 A * 6/1990 Dobbins et al. ..... 124/73
5,280,778 A * 1/1994 Kotsiopoulos ..... 124/31
5,515,838 A * 5/1996 Anderson ..... 124/73
5,542,406 A * 8/1996 Oneto ..... 124/50
5,572,982 A * 11/1996 Williams ..... 124/74
5,640,945 A * 6/1997 Slonaker et al. ..... 124/56
5,727,538 A 3/1998 Ellis ..... 124/77
5,823,173 A * 10/1998 Slonaker et al. ..... 124/56
5,881,707 A * 3/1999 Gardner, Jr. ..... 124/32
5,884,615 A * 3/1999 Casas Salva ..... 124/31
5,908,024 A * 6/1999 Staev ..... 124/31
5,967,133 A * 10/1999 Gardner, Jr. ..... 124/32
6,003,504 A * 12/1999 Rice et al. ..... 124/73
6,035,843 A * 3/2000 Smith et al. ..... 124/32
6,065,460 A 5/2000 Lotuaco ..... 124/72
6,138,656 A * 10/2000 Rice et al. ..... 124/73
6,213,112 B1 * 4/2001 Squire ..... 124/74

* cited by examiner

*Primary Examiner*—Charles T. Jordan
*Assistant Examiner*—Stephen A Holzen
(74) *Attorney, Agent, or Firm*—George F. Helfrich

(57) ABSTRACT

An improved paintball marker bolt and bolt head uses a curved gas inlet ramp and geometrically designed outlet holes to provide pressurized gas flow with decreased turbulence and more uniform distribution over the paintball surface. The improvements in gas flow and pressure distribution are combined with other mechanical improvements related to drive transfer, friction reduction, and bolt assembly, resulting in a significantly improved marker bolt. Improvements are realized in increased gas flow efficiency, increased paintball velocity (by 30 feet per second or more), increased range, improved shot consistency (less than a 2½% variation in shot-to-shot paintball velocity), decreased jamming, and decreased premature paintball breakage.

34 Claims, 5 Drawing Sheets

HIGH EFFICIENCY PAINTBALL MARKER BOLT AND BOLT HEAD

This application claims the benefit of U.S. Provisional Application No. 60/241,802, filed Oct. 19, 2000, and entitled "Universal Paintball Marker Bolt Head."

BACKGROUND OF THE INVENTION

1. Field of the Invention

The subject invention relates to pressurized gas powered guns, or "markers," for firing paintball projectiles. The invention relates more specifically to a particular component of a paintball marker called the firing bolt, and for particular applications, the bolt head.

2. Description of the Related Art

Paintball guns, commonly called markers, are most often used for target practice and mock war games. Paintball war games began gaining popularity as a sport in the early 1980's, leading to the commercial development of a variety of paintball equipment. The paintball marker uses pressurized air, carbon dioxide, or nitrogen to propel paintball projectiles out the barrel of the gun. The paintball itself is a spherical, brittle gelatin casing containing a paint mixture of ethylene glycol, water and titanium dioxide. The paintball is propelled from the barrel of the gun and designed to rupture on impact with the intended target, for example an opposing paintball war game player.

A number of typical problems occur when firing paintball marker guns. One common problem is that the somewhat fragile paintballs tend to break before they leave the gun, due to excessive bolt impact or gas pressure forces on the ball. Premature ball breakage within the gun barrel results in clogging, shot misdirection, decreased paintball velocity, and a number of other problems, in addition to the cleanup nuisance it creates.

Even without paintball breakage, a number of flaws often hinder the performance and reliability of the paintball marker. The force of the gas impacting the paintball tends to be inconsistent. As a result, shot accuracy is diminished, and distance and velocity are unpredictable. Accommodations must be made for the uncertainty created by the inconsistent gas flow, often resulting in reduced performance. For example, gas pressures must often be regulated at a level lower than the ideal, to allow for the possibility that spikes in pressure might cause the paintball velocity to exceed the allowable limit in war game competition (maximum allowable velocity is usually 300 feet per second). Due to typically inherent inefficient gas flow and inconsistency in impact pressure, paintball marker pressure may be regulated as much as 10% lower than the ideal level for maximum allowable velocity (and therefore, also maximum allowable range).

A number of improvements have been developed for paintball guns in general, as evidenced by a variety of patents issued for inventions related to paintball gun triggers, loaders, air valves, barrels, projectile containers, air reservoirs, and gravity center compensation. Very little improvement has been made, however, in paintball marker bolts, even though the bolt is a critically important component of the system which transfers pressurized gas to the paintball projectile. Bolts have been manufactured with increased inner diameters to maximize the amount of gas flow reaching the projectile, but this modification does not address the turbulent nature of the flow, and therefore doesn't maximize gas flow efficiency. Bolts have also been custom manufactured for individual consumers' paintball guns, using very close diametrical tolerances to minimize the opportunity for leakage around the bolt. While this may result in improved flow efficiency, it often requires the gun owner to ship his gun to the manufacturer for measurement so that the bolt can be fabricated to fit the gun precisely. In addition to the inconvenience this causes, it often results in gun jamming, as the unusually close tolerances become too tight when humidity or cold weather causes swelling of the bolt or contraction of the barrel.

As a result, paintball gun performance (i.e. velocity, range, and accuracy) is often not what it otherwise could be. What is needed is a bolt which provides improvement in gas pressure delivery efficiency and consistency, such that maximum allowable pressures (based on maximum allowable velocity) are delivered to the paintball in a reliable and consistently repeatable manner, not only improving shooting accuracy, range, and velocity, but also decreasing the rate of premature paintball breakage inside the gun.

BRIEF SUMMARY OF THE INVENTION

Accordingly, it is an object of the present invention to provide a paintball marker bolt which allows a paintball gun to fire paintball projectiles with minimal premature breakage.

It is another object of the present invention to provide a paintball marker bolt which improves the consistency between shot-to-shot paintball velocity and distance when fired from a paintball marker.

It is yet another object of the present invention to provide a paintball marker bolt which allows a lower gas pressure to be used when firing a paintball marker, as improved velocity and distance makes higher pressure unnecessary.

It is an additional object of the present invention to provide a paintball marker bolt with improved mechanical performance, including better sliding action, less jamming, and improved drive transfer from the paintball gun hammer.

The present invention is an improved paintball marker bolt which accomplishes the objects above. These and other objects will become more readily appreciated and understood from a consideration of the following detailed description of the exemplary embodiment, when taken together with the accompanying drawings.

The preferred embodiment of the subject invention is a marker bolt manufactured from a machinable thermoplastic material. The bolt has a cupped face which matches the paintball curvature, and a plurality of holes in its face geometrically designed to minimize gas flow turbulence and produce a uniform distribution of the pressurized gas which impacts the paintball. An elongated and angled inlet hole ensures alignment with the pressurized gas supply, and begins directing the gas in an angled, partially axial direction within the bolt. A curved air ramp/plug seals the rear of the bolt from leakage, and provides a smooth, non-turbulent transition from angled gas flow to fully axial flow, increasing paintball velocity by as much as 30 feet per second according to users' test results. An adjustable combination lock and drive pin holds the ramp in place, provides firm drive transfer from the gun hammer, and secures the bolt head to other bolt components. Precision tolerances on external dimensions, combined with a slightly decreased diameter over a portion of the bolt, provide a leak-free seal around the bolt, while decreasing friction during bolt movement. An optional diffuser cone assists in directing flow through the distributing holes in the bolt face. The combination of these components in the preferred embodiment of the present invention provides a significantly improved paintball marker bolt in accordance with the objects outlined above.

DETAILED DESCRIPTION OF THE INVENTION

Background to the Description

Figure 1:
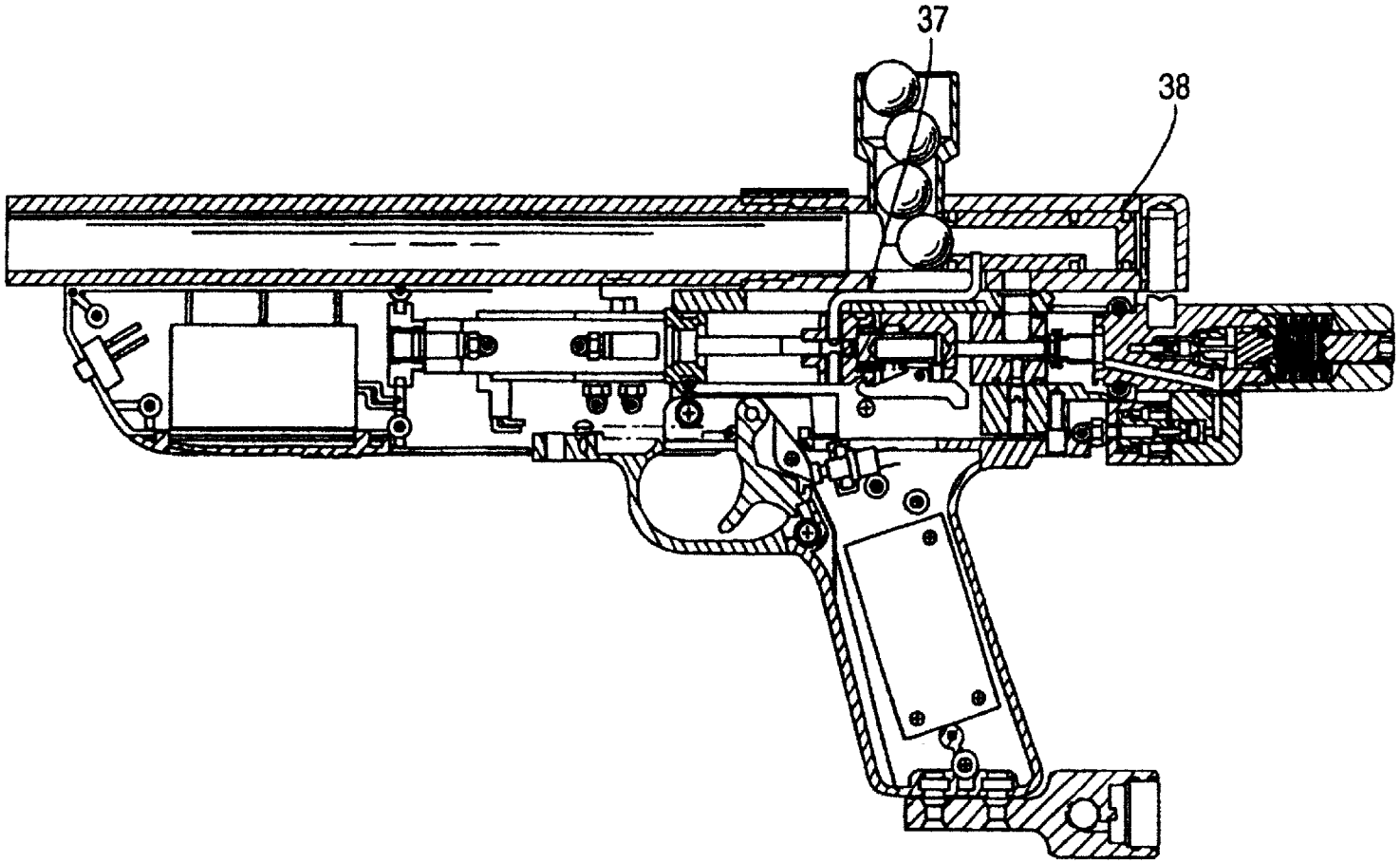
FIG. 1 (Prior Art)
FIG. 1 is a cross-sectional view of the internal workings of a paintball gun.
Figure 2:
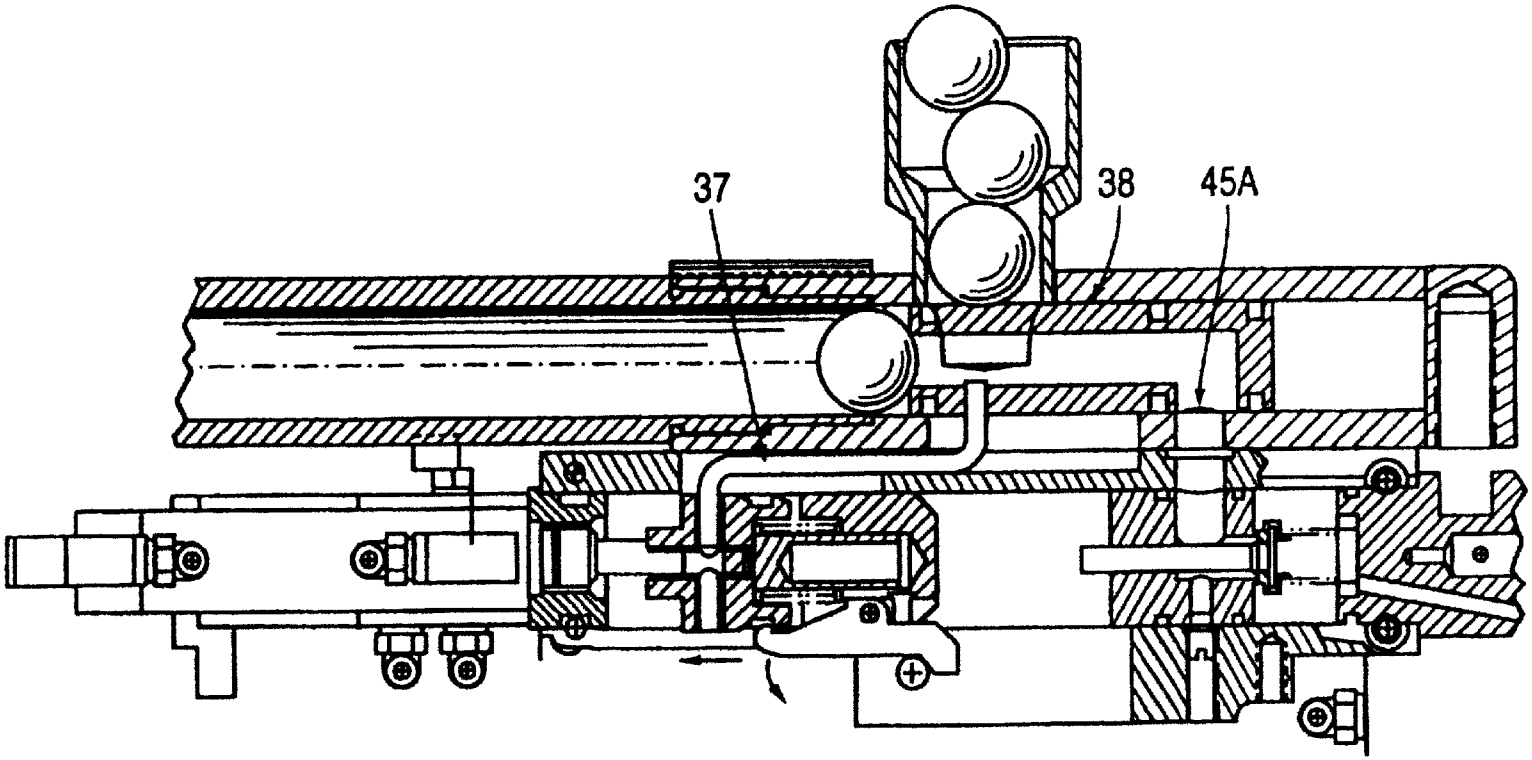
FIG. 2 (Prior Art)
FIG. 2 is a closer view of the hardware illustrated in FIG. 1, focusing on the section of the paintball gun in which the bolt is located.
Figure 3:
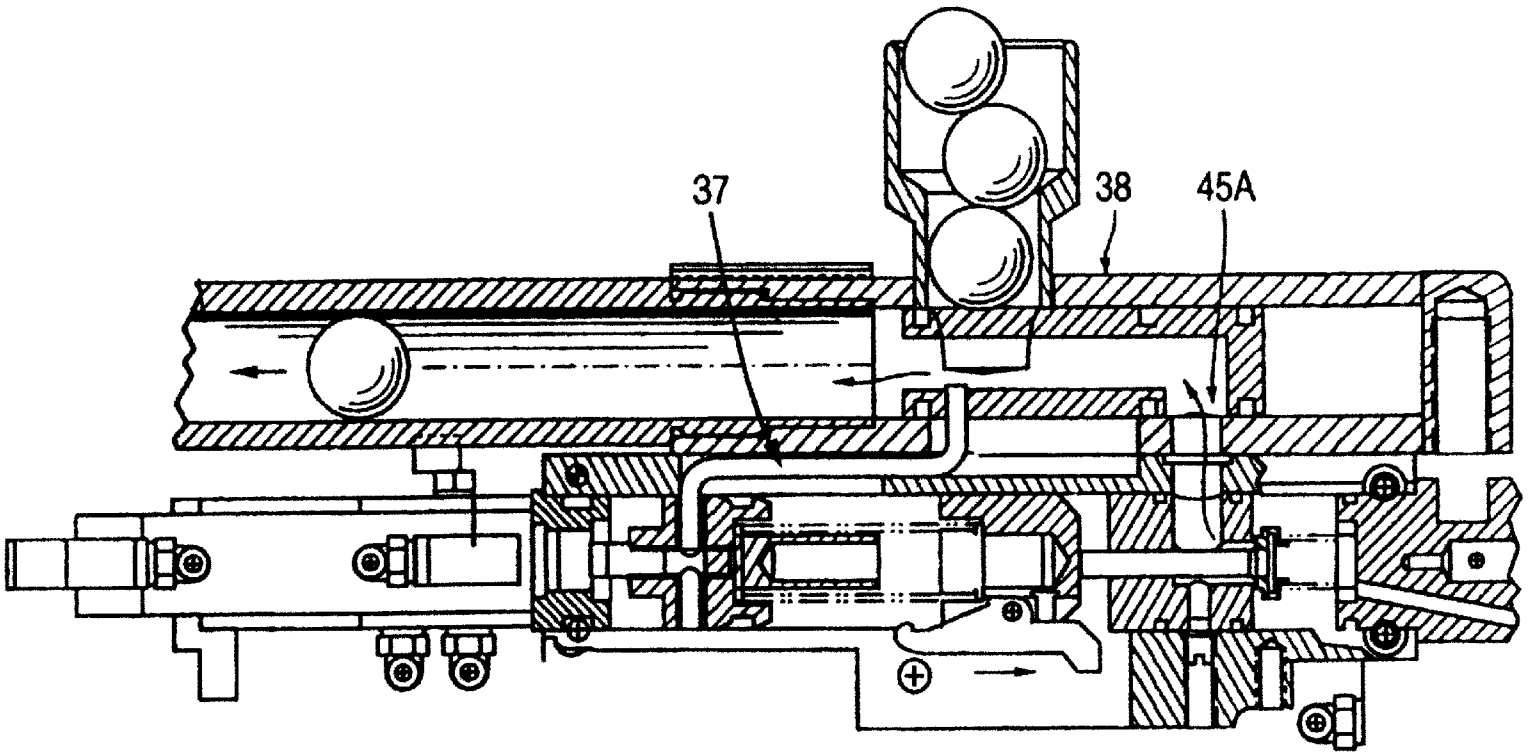
FIG. 3 (Prior Art)
FIG. 3 is the same cross-sectional view as in FIG. 2, but in this case illustrating the expulsion of a paintball projectile from the barrel of the paintball gun.

The present invention is a firing bolt, a component of a paintball gun, also known as a paintball marker. An example of the mechanical workings of a paintball gun is described in U.S. Pat. No. 6,065,460 to Lotuaco, hereby incorporated by reference into the present application. FIG. 1 of the present application is FIG. 2 from the Lotuaco patent, and provides a cut-away view of the internal workings of a paintball gun. The functioning of the various components of Lotuaco's paintball gun is described in column 2, line 30, through column 4, line 36. A closer view of the mechanics involving the bolt is illustrated in instant FIG. 2, which is FIG. 3 of Lotuaco's patent. In instant FIG. 2, item 38 is the bolt used in Lotuaco's paintball gun. The bolt 38 is a typically cylindrical device that accepts pressurized gas from through an inlet port 45A, and channels it to a paintball projectile B, expelling it from the barrel 01 of the paintball marker/gun as depicted in FIG. 3 of the present application, which is FIG. 4 from the Lotuaco patent.

Manufacturers, consumers, and others, practiced in the arts of making and using paintball guns and their associated hardware, are familiar with a number of variations on the mechanisms by which paintball guns operate. A synopsis of the different types of guns, and some of the problems encountered with their use, is presented in U.S. Pat. No. 5,727,538 by Ellis, hereby incorporated by reference into the present application. Ellis's "Description of Prior Art" in column 1, line 9 through column 5, line 3, provides an overview of some variations on the general design of a pressurized gas powered paintball gun.

Regardless of the variation on design, the typical paintball gun utilizes a bolt to guide pressurized gas from its source, usually a tank of compressed gas, to the paintball projectile. In some paintball guns which use a particular type of cocking mechanism, the bolt is the forward component of a larger piece of hardware. In this instance, the bolt (or the bolt as described in the present application) is referred to as a "bolt head." The present invention therefore may be referred to as a bolt, or as a bolt head, depending on its particular application. As stated earlier, those practiced in the arts of making and using paintball guns and their components are fully aware of the variations of gun and bolt design, as well as the differences and similarities between a bolt and a bolt head. For the purposes and objectives of the present invention, they may be considered to be effectively the same.

Detailed Description of the Present Invention

Figure 6:
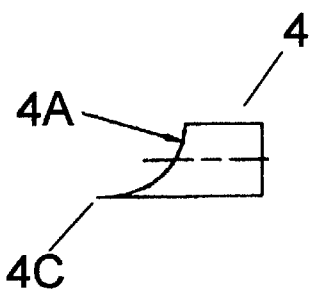
FIG. 6 is a detail view of one embodiment of a bolt ramp/plug associated with the present invention.
Figure 5:
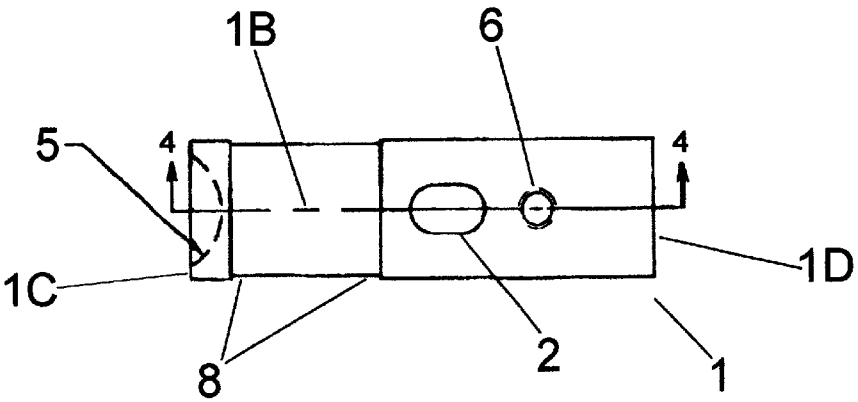
FIG. 5 is a top view of the embodiment depicted in FIG. 4.
Figure 4:
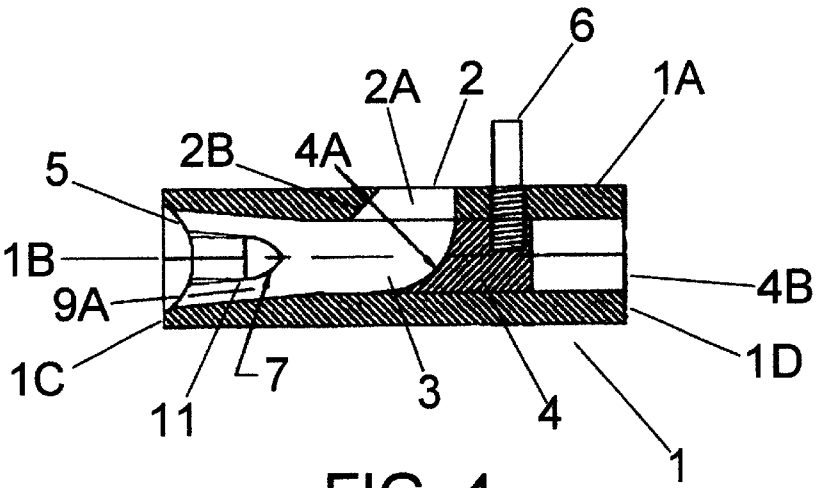
FIG. 4 is a cross-sectional view of one embodiment of the present invention.

Referring now to FIG. 4, a cross-sectional side view of one embodiment of the present invention is depicted. The depicted embodiment is a paintball gun bolt, comprising a substantially cylindrical body 1, with an external surface 1A, a body centerline 1B, a forward end 1C, an aft end 1D, an inlet hole 2, an inlet hole border wall 2A, an inlet hole internal leading edge 2B, an internal passageway 3, a ramp 4, a flow-directing ramp surface 4A, a ramp assembly hole 4B, a face 5, a pin 6, and an optional diffuser cone 7. FIG. 4 is a cross-section through A—A of FIG. 5, which further illustrates a top view of the same embodiment. FIG. 5 also illustrates an undercut section 8. FIG. 6 depicts an end view of the same embodiment, showing a plurality of exit holes 9, including a center hole 10, and the geometrical center 10A of the face 5.

Referring now to FIG. 4 again, the current best mode of the substantially cylindrical body 1 is fabricated primarily from a machineable thermoplastic material. An example of a suitable material is polyoxymethylene, commonly known as acetal. Acetal can be obtained under the trademark "Delrin" from Boedecker Plastics, Inc (1-800-444-3485; www.boedecker.com). Acetal is easily machined, provides high strength and stiffness, is dimensionally stable, and can be purchased in a variety of forms including colored thermoplastics or filled thermoplastics.

Another suitable thermoplastic is polyethylene terephthalate, or PET-P. PET-P has beneficial properties such as dimensional stability and low water absorption, similar to those of acetal, and can be purchased under the trademark "Ertalyte" from DSM Engineering Plastic Products, Inc. (see www.dsmepp.com).

Other machineable materials such as metals, filled thermoplastics, or other plastics might be used, especially if the selected material is capable of sliding within the gun barrel without jamming and has good wear resistance, and especially if the material has a fairly low thermal coefficient of expansion, or a thermal coefficient matched to the gun materials. To help decrease friction, and thereby improve the sliding action of the bolt, the external diameter of the cylindrical body 1 has an undercut section 8. As shown in FIG. 5, undercut section 8 is slightly smaller in diameter than the external diameter of the rest of the body 1. The slightly smaller diameter causes undercut section 8 to avoid contact with the barrel or other paintball gun hardware, thus decreasing the amount of friction caused by the sliding contact of the external surface 1A of body 1.

Still referring to FIG. 5, the body 1 has an inlet hole 2 which allows inlet gas from the paintball gun's pressurized gas source to enter the bolt. The inlet hole 2 can be nearly any size and shape suitable for accepting gas from source, but the preferred embodiment, as illustrated in FIG. 5, is an oval shape which ensures alignment between the inlet hole 2 of the bolt and the outlet hole from the gas source. As shown in FIG. 4, the inlet hole 2 also has a border wall 2A, the internal leading edge 2B of which is sloped toward the forward end 1C of the body 1. The forward slope of the internal leading edge 2B, while not critical, begins the process of decreasing the gas flow turbulence by helping to direct the flow initially toward the forward end 1C of the bolt.

Still referring to FIG. 4, a ramp 4 has a flow-directing surface 4A designed to gently turn the incoming gas toward the forward end 1C of the bolt, thereby minimizing and essentially eliminating flow turbulence, and therefore maximizing the efficiency of the bolt's performance. The ramp 4 is situated inside the body 1 so that the flow-directing surface 4A is exposed to both the inlet hole 2 and an internal passageway 3, through which the gas flow travels after being guided by the flow-directing surface 4A.

FIG. 6 is a detail view of one embodiment of the ramp 4. The ramp 4 may be made of Delrin or Ertalyte or other thermoplastics or materials similar to that of the body 1. Preferably it is made of the same or similar material at least for thermal expansion and contraction considerations. The ramp 4 does not, however, have to slide fore and aft within the paintball gun hardware (e.g. the barrel), so it's lubricity is not a factor. In fact, it is possible that the ramp 4, and especially the flow-directing surface 4A can be made as an integral part of the body 1, by the use of a ball-end mill, electron discharge machining methods, or other processes. In the current embodiment of the present invention, however, the ramp 4 is a substantially cylindrical piece which fits into a ramp assembly hole 4B as shown in FIG. 4. The ramp assembly hole 4B, and therefore the mating cross-sectional geometry could easily be any number of shapes as long as they mate to one another, but a circular hole and ramp are easily manufactured. In the current embodiment, the hole is centered along body centerline 1B and drilled from the aft end 1D of body 1, and the ramp 4 is manufactured to fit snugly within the ramp assembly hole 4B. Thus assembled, the ramp 4 not only serves to guide gas flow toward the forward end 1C of the bolt, but also plugs the ramp assembly hole 4B, preventing unwanted flow from leaking out the aft end 1D.

The flow-directing surface 4A is a two-dimensional, circular curve with a sharp front edge 4C (as shown in FIG. 6), although a variety of other geometries would be easily envisioned by one practiced in the arts associated with air flow control or paintball gun design. For example, the flow-directing surface 4A can be a two-dimensional, elliptical curve, or it can be a three dimensional curve, spherical or otherwise. Testing by paintball gun users has shown that the current embodiment utilizing a two-dimensional, circular curve significantly improves gas flow and shot efficiency, but it is envisioned that other curvatures are at least as effective.

Referring again to FIG. 4, the gas flow passes through an internal passageway 3 after leaving the flow-directing surface 4A of the ramp 4. Although many aerodynamic internal contours can be envisioned by one practiced in the art of flow control or aerodynamics, the internal passageway 3 in the current embodiment of the present invention is circular, produced in part by the same drilling operation that produced the ramp assembly hole 4B. The internal passageway 3 is entirely enclosed by the body 1, except for its opening at the inlet hole 2 and at the face 5 in the forward end 1C of the body 1. The purpose of the internal passageway 3 is to aerodynamically channel the gas flow from the inlet hole 2, past the flow-directing surface 4A, and out through the face 5, in as unturbulent a manner as possible.

Figure 7:
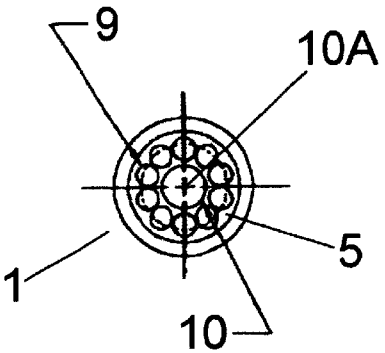
FIG. 7 is an end view of one embodiment of a bolt face associated with the present invention.
Figure 8:
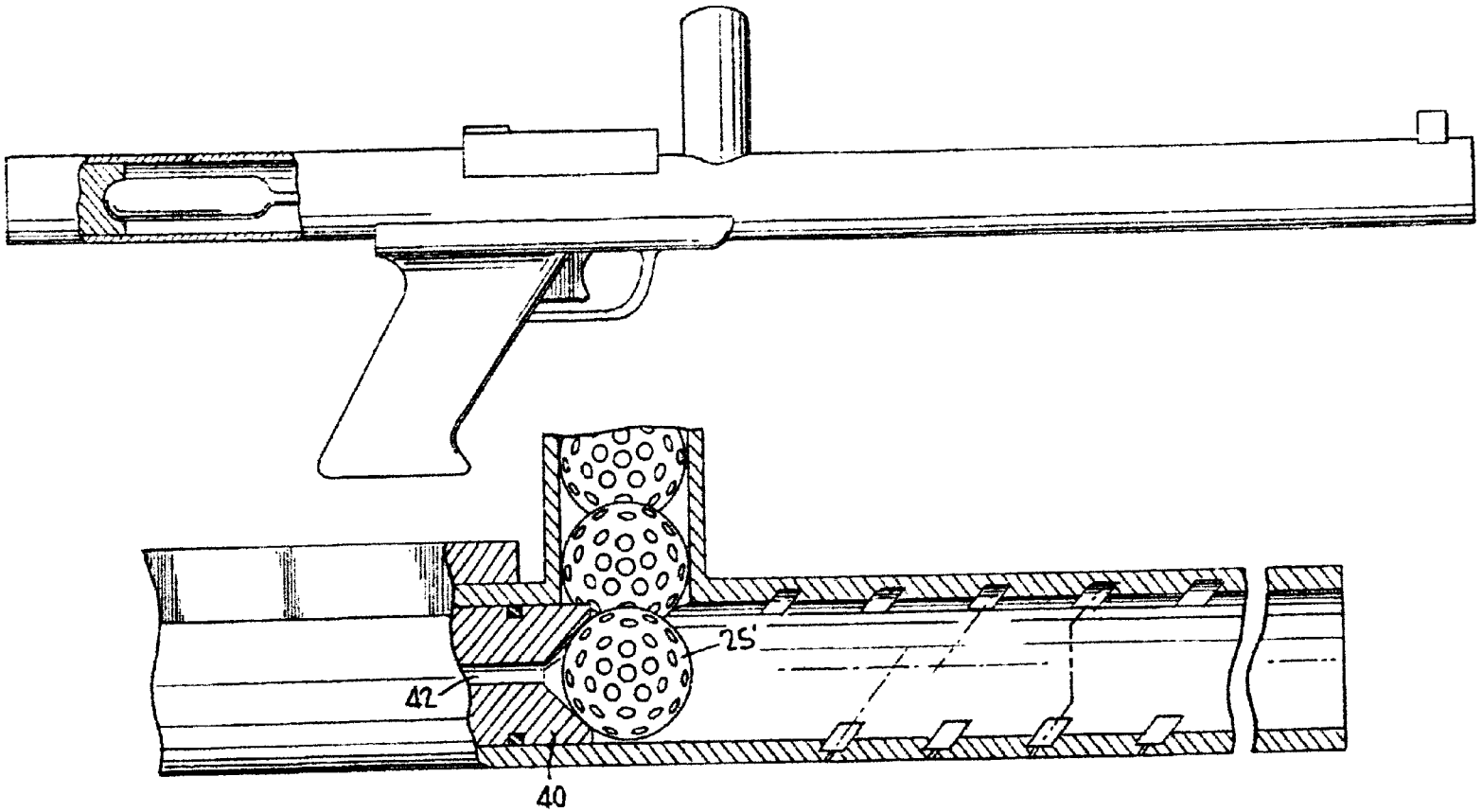
FIG. 8 (Prior Art)
FIG. 8 is a side view of a paintball gun, and a cutaway section of a portion of the gun illustrating the cupping relationship between a bolt and paintball.

Referring to FIG. 7, an end view of one embodiment of the face 5 (in forward end 1C) is depicted. Although a variety of patterns are easily envisioned, the current embodiment of the present invention comprises a circular pattern of evenly spaced exit holes 9, radially surrounding the geometrical center 10A of the face 5. Referring back to FIG. 4, a side view illustrates that the face 5 in the preferred embodiment is concave, with the curvature designed to fit the geometry of a typical (spherical) 0.680 caliber paintball. U.S. Pat. No. 5,823,173 to Slonaker, hereby incorporated by reference into the present application, provides a clear illustration of how the paintball is cupped by the face of the bolt. FIG. 8 of the present application is a combination of FIGS. 1 and 4 from Slonaker's patent, showing a side view of a paintball gun and a cutaway section of the gun with the paintball and leading edge of the bolt exposed. In FIG. 8, the concave face of the bolt 40 cups the paintball projectile 25'. A narrow internal (central) passageway 42 is also illustrated. Pressurized gas expelled through the passageway 42 impacts the paintball 25', firing it out the barrel. The cupped and fitted nature of the face provides an efficient transfer of pressure from the expelled gas to the projectile paintball.

Referring back to FIG. 7, an embodiment of the face 5 of the present invention is shown. A concave face 5 with a plurality of exit holes 9 is commonly called a "Venturi Face" among paintball enthusiasts. The preferred embodiment of the present invention comprises an improvement of the typical Venturi face. A typical Venturi face may contain six to eight exit holes; a preferable embodiment of the present invention comprises ten exit holes 9 in a circular pattern, and one additional larger exit hole, a center hole 10, centered on the geometrical center 10A of the face 5.

Typical Venturi face exit holes are drilled straight into the face of the bolt, e.g. parallel with the body centerline 1B in FIG. 4. An improvement provided by a preferred embodiment of the present invention over typical designs resides not only in the number of exit holes, but also in the angled direction in which they are drilled, and in the internal flow benefits resulting from the angled drilling. As depicted in FIG. 4, the exit holes are drilled at a shallow angle to the body centerline 1B. Exit hole centerline 9A is angled about five degrees from body centerline 1B, and is typical of the exit holes 9 encircling the face 5. Exact angles may vary, but should be about the same around the circular pattern of exit holes 9. Depending on the exact drilling angle used, the centerlines of exit holes 9 will converge at some point along body centerline 1B; closer for steeper drilling angles and further for more shallow drilling angles.

Meanwhile, as shown in FIGS. 4 and 7, center hole 10 is drilled straight into the face 5, centered at geometric center 10A, with its drilling center co-linear with body centerline 1B. The intersection of exit holes 9 and center hole 10 creates a circular pattern of sharp edges 11 surrounding the body centerline 1B and facing the flow traveling toward the forward end 1C of the bolt through the internal passageway 3. The gas flow, which has been made less turbulent by its flow guidance from the ramp 4, is cleanly divided by the sharp edges 11 and directed through the exit holes 9 and center hole 10, where it impacts the paintball projectile in a highly efficient manner. Not only does the improved gas flow efficency result in greater paintball velocity and distance (approximately ten percent improvement according to users' test results), and shot consistency (less than a 2½% variation in shot-to-shot paintball velocity), but the improved distribution of gas impacting the paintball decreases the probability of prematurely rupturing paintballs within the barrel of the gun.

One variational embodiment of the present invention includes an optional diffuser cone 7, depicted in FIG. 4. The diffuser cone 7 is shaped aerodynamically to guide the gas flow through the exit holes 9. It can be fabricated as a plug which inserts into the center hole 10, or it can be an integral part of the internal geometry of the body 1. An embodiment which uses the diffuser cone 7 may presumably experience fewer premature paintball ruptures, since no pressurized gas impacts the paintball at its center. All the gas exits through the circumferential exit holes 9, thereby impacting the paintball more indirectly around its outer edges. Such a design may have application with "blowback" type paintball markers, which operate at significantly higher pressure than other guns. For non-blowback paintball guns, however, the preferred embodiment utilizes the center hole 10 and sharp edges 11, maximizing not only the decrease in turbulence and increase in flow efficiency, but also the maximizing the flow volume which reaches the paintball.

One other variation of the present invention is a bolt in which the exit holes 9 are drilled using a different angle pattern, such that the gas flow exiting the exit holes 9 is distributed in such a way as to impart backspin or other effects to the paintball. In addition, the exit holes 9, as well as the internal passageway 3, the inlet hole 2, and other machined items can be produced by operations other than drilling, for example electron discharge machining, and therefore can be envisioned as having geometries other than circular, should a different geometry provide other benefits.

Yet another variation within the scope of the present invention is an embodiment with only one exit hole (instead of a multi-port bolt face), characterized by an open front face that tapers down in diameter until it reaches an internal passageway or air inlet. The benefit of such an embodiment would be the maximization of flow volume.

One other embodiment is a bolt with no center hole, which decreases the direct impact to the paintball, and thus prevents premature breakage, especially in cold climates where the paintball wall tends to be most brittle.

Referring again to FIG. 4, a pin 6 is depicted, protruding from the external surface 1A of the body 1. The pin 6 functions as a combination lock and drive pin. As a drive pin, the pin 6 interacts with other hardware in a typical paintgun (e.g. a "hammer") to provide fore and aft drive transfer. Pin 6 serves the function of the link 37 of instant FIG. 2 (FIG. 3 of the Lotuaco patent, number 6,065,460). As such, the actual pin 6 geometry may change considerably, but its function and composition remains the same. The pin 6 is preferably made of stainless steel to avoid corrosion and to ensure strength, although other metals and suitable structural materials may be appropriate. At least one embodiment of pin 6 improves upon typical links and drive pins, in that it is made in an adjustable mode. As shown in FIG. 4, body 1 and ramp 4 can be tapped and pin 6 threaded, so that the effective length (outside external surface 1A) can be made longer or shorter. Typically, inaccurate fits cause links and drive pins to malfunction or to wear inordinately. The adjustable length of pin 6 addresses this problem directly. Also, the threaded pin remains in place more effectively than typical drive pins, which are normally pressed into place.

Serving as a positional lock, pin 6 as shown in FIG. 4 can be used to hold ramp 4 in position. Pin 6 can also be used as a set screw to fix the bolt to other hardware, in which case the bolt can become a "bolt head," as described earlier. A variety of other practical uses for the pin 6 can be envisioned by the skilled paintball gun user, designer, or manufacturer.

A paintball gun bolt is a marker component familiar to all those skilled in the art of making and using paintball guns. Its mode of assembly and use with certain paintball guns, or modification and use with others, is readily envisioned by such users and makers, and the same is true of the present invention. There are a wide variety of types of paintball guns, bolts, and other components available, but they all generally operate on similar principles of gas powered propulsion. Variations in the present invention are to be expected, and should be considered to fall within the scope of the described invention when benefitting from the design advantages described above.

It may be of some benefit to describe one process by which one embodiment of the present invention can be manufactured. Depending upon the desired final dimensions, the bolt may be fabricated from ¾ inch round stock of a thermoplastic material, and cut to the approximate desired length. Using a lathe, the body 1 can be turned to rough diameter dimensions and faced off to final length. The ramp assembly hole 4B can be drilled (e.g. ⅜ inch diameter, 1.900 inches deep) from the aft end 1D to accommodate the ramp 4 as well as to form the basis for the internal passageway 3. Using a specially designed, angled hole jig, ten exit holes 9 can be drilled 7⁄64 inches in diameter, and at five degree angles to the body centerline 1B. The inlet hole 2 can be milled 0.390 inches long using a ¼ inch end mill, then a 45 degree angle can be milled into the internal leading edge 2B of the inlet hole 2. An air ramp 4 can be fabricated from ⅞ inch long by ⅜ inch round stock (thermoplastic material), cutting a 0.900 inch radius on the forward end until a sharp front edge 4C is formed. The ramp assembly hole 4B can be bored 0.002–0.005 inches larger in diameter to accept the ramp 4, then the ramp 4 can be assembled into the body 1 with a medium press fit. The hole for the pin 6 can be tap drilled 5⁄32 inches in diameter by 0.650 deep, then tapped with a 10–32 NF starting tap 0.600 inches deep. Again using a lathe, the bolt body 1 can be turned to a 0.710 inch diameter, then chamfered at both ends. A 0.340 inch radius can be machined into the face 5 of the bolt using a radius tool, to form a cup for the paintball. A center hole 10 can be drilled through from the face 5, using a #2 drill, and forming the flow-separating sharp edges 11 internally. The undercut section 8 can be produced by turning 0.006 inches from the outside diameter of the body 1. The pin 6 can be made from a one inch long 10–32 NF 316 grade stainless steel set screw, and installed in the bolt to the desired depth. This fabrication process will result in an embodiment of the present invention suitable for use with an Angel brand paintball marker. Machining procedures, inlet hole placement, final finished diameter, pin location and dimensions, and other factors would be altered depending on the particular model of the paintball marker for which the bolt is manufactured, but the benefits of the present invention as described above would still apply.

In summary, the descriptions of the present invention represent the invention in its preferred embodiments. It should be understood and reiterated that additional changes in the details, materials, and part arrangements may be made by those skilled in the art within the principle and scope of the invention as expressed in the appended claims. This is particularly true for an invention such as the present one, a component of a device (a paintball gun) which varies to some degree from product to product.

Although the invention has been described relative to specific embodiments, there are numerous variations and modifications that will be readily apparent to those skilled in the art in light of the above teachings. It is therefore to be understood that, within the scope of the appended claims, the invention may be practiced other than as specifically described.

The invention claimed is:

1. A paintball marker bolt, comprising:

a substantially cylindrical body, having an external diameter, a body centerline defined by the external diameter, an external surface, a forward end and an aft end, an internal passageway contained within the body, and an inlet hole connecting the external surface to the internal passageway;

a face, centered upon the forward end of the substantially cylindrical body, the face having a geometrical center and at least one exit hole connecting the face to the internal passageway; and a separately prefabricated ramp, situated inside the substantially cylindrical body, and having a flow-directing surface exposed to both the inlet hole and the internal passageway.

2. A paintball marker bolt according to claim 1, wherein the face is contoured in a semi-spherical shape to match a paintball geometry.

3. A paintball marker bolt according to claim 2, wherein the flow-directing surface of the ramp is shaped so that it directs flow from the inlet hole toward the face by way of the internal passageway.

4. A paintball marker bolt according to claim 3, wherein the flow-directing surface of the ramp is sloped.

5. A paintball marker bolt according to claim 3, wherein the flow-directing surface of the ramp is curved in two dimensions.

6. A paintball marker bolt according to claim 5, wherein the two-dimensional curvature of the flow-directing surface of the ramp is defined by a circular geometry.

7. A paintball marker bolt according to claim 5, wherein the two-dimensional curvature of the flow-directing surface of the ramp is defined by an elliptical geometry.

8. A paintball marker bolt according to claim 5, wherein the flow-directing surface of the ramp is curved in three dimensions.

9. A paintball marker bolt according to claim 8, wherein the three dimensional curvature of the flow-directing surface of the ramp is defined by a spherical geometry.

10. A paintball marker bolt according to claim 5, wherein a plurality of the exit holes surround the geometrical center of the face.

11. A paintball marker bolt according to claim 10, wherein the plurality of the exit holes are machined at an angle to the body centerline.

12. A paintball marker bolt according to claim 11, wherein an intersection between at least one exit hole and the internal passageway creates a sharp edge.

13. A paintball marker bolt according to claim 12, wherein one exit hole is a center hole.

14. A paintball marker bolt according to claim 12, wherein the plurality of exit holes form a circular pattern about the geometrical center of the face.

15. A paintball marker bolt according to claim 14, wherein the face contains at least six exit holes.

16. A paintball marker bolt according to claim 14, wherein the face contains at least eight exit holes.

17. A paintball marker bolt according to claim 14, wherein the face contains at least ten exit holes.

18. A paintball marker bolt according to claim 14, wherein the angle at which the exit holes are machined is about five degrees to the body centerline.

19. A paintball marker bolt according to claim 18, wherein a plurality of lines defined by centers of the machined exit holes converge at a point along the body centerline.

20. A paintball marker bolt according to claim 19, wherein the inlet hole is substantially oval-shaped.

21. A paintball marker bolt according to claim 20, wherein the inlet hole has a border wall defined by the geometry of the inlet hole at the external surface of the body and the geometry of the inlet hole at the intersection between the inlet hole and the internal passageway.

22. A paintball marker bolt according to claim 21, wherein the border wall of the inlet hole has a two dimensional geometry.

23. A paintball marker bolt according to claim 22, wherein the border wall of the inlet hole has a three dimensional geometry.

24. A paintball marker bolt according to claim 23, wherein the border wall has an internal leading edge, which slopes toward the face of the substantially cylindrical body.

25. A paintball marker bolt according to claim 24, wherein a pin protrudes from the substantially cylindrical body.

26. A paintball marker bolt according to claim 25, wherein the pin is manufactured from a stainless steel alloy.

27. A paintball marker bolt according to claim 26, wherein the pin possesses a means for adjusting the length by which it protrudes from the substantially cylindrical body.

28. A paintball marker bolt according to claim 27, wherein the pin is threaded, and the substantially cylindrical body has a hole in its external surface, which is tapped to match the thread pattern of the threaded pin.

29. A paintball marker bolt according to claim 28, wherein the substantially cylindrical body and the ramp are made from a plastic material.

30. A paintball marker bolt according to claim 29, wherein the substantially cylindrical body and the ramp are made from a thermoplastic material.

31. A paintball marker bolt according to claim 30, wherein the substantially cylindrical body and the ramp are made from acetal.

32. A paintball marker bolt according to claim 30, wherein the substantially cylindrical body and the ramp are made from polyethylene terephthalate.

33. A paintball marker bolt according to claim 30, wherein a portion of the external diameter of the substantially cylindrical body is undercut to a diameter smaller than the external diameter of the substantially cylindrical body.

34. A paintball marker bolt according to claim 33, further comprising a diffuser cone centered within the internal passageway in such a way as to divide gas flow substantially equally among the plurality of exit holes.

* * * * *